United States Patent [19]

Krüger

[11] Patent Number: 4,517,938

[45] Date of Patent: May 21, 1985

[54] ROTARY VALVE ARRANGEMENT

[75] Inventor: Hermann Krüger, Wolfsburg, Fed. Rep. of Germany

[73] Assignee: Volkswagenwerk Aktiengesellschaft, Wolfsburg, Fed. Rep. of Germany

[21] Appl. No.: 547,763

[22] Filed: Nov. 1, 1983

[30] Foreign Application Priority Data

Nov. 11, 1982 [DE] Fed. Rep. of Germany ..... 3241723

[51] Int. Cl.[3] ..... F01L 7/10

[52] U.S. Cl. ..... 123/190 E; 123/190 BB; 123/190 BA

[58] Field of Search ..... 123/190 BC, 190 BB, 123/190 E, 190 B, 190 BA, 190 DL; 29/157.1 R, 156.7 A; 251/368

[56] References Cited

U.S. PATENT DOCUMENTS

| | | | |
|---|---|---|---|
| 1,073,770 | 9/1913 | Martin | 123/190 BC |
| 1,088,714 | 3/1914 | Meaker | 123/190 E |
| 1,169,235 | 1/1916 | Butler | 123/190 BB |
| 2,116,022 | 5/1938 | Gross | 123/190 BB |
| 3,405,701 | 10/1968 | Mealin | 123/190 B |
| 3,592,440 | 7/1971 | McFarland | 251/170 |
| 3,767,164 | 10/1973 | Robinson | 251/368 |
| 3,770,009 | 11/1973 | Miller | 251/368 |
| 3,829,061 | 8/1974 | Dayne | 251/368 |
| 3,917,149 | 11/1975 | Breton | 29/420.5 |
| 4,221,307 | 9/1980 | Peterson | 251/368 |

*Primary Examiner*—Ronald H. Lazarus

*Attorney, Agent, or Firm*—Brumbaugh, Graves, Donohue & Raymond

[57] ABSTRACT

In the specific embodiment described herein, a rotary valve for the gas exchange of an internal combustion engine has a rotary member and a housing and a series of circumferential dry-bearing gas-sealing rings and dry surface seals arranged to block leakage between adjacent passageways in the valve member and the housing.

15 Claims, 2 Drawing Figures

ROTARY VALVE ARRANGEMENT

BACKGROUND OF THE INVENTION

The invention relates to rotary valves and, more particularly, to a new and improved rotary valve arrangement especially adapted for use in internal combustion engines.

Rotary valves have several fundamental advantages over conventional tappet valves for controlling the cylinder intake and exhaust in internal combustion engines. One advantage results from the elimination of inertial forces and impacts, making rotary valves silent and functionally independent of speed. Furthermore, with rotary valve control, large gas flow cross sections can be achieved, which enhances the attainable power output of the engine. To provide the same power output with tappet valves, it would be necessary to provide as many as four inlet valves per cylinder. Moreover, with rotary valves a compact, unitary combustion chamber directly exposed to the intake flow is attainable.

Widespread use of rotary valves to control the intake and exhaust of internal combustion engines has long been hindered by sealing problems. In German Offenlegungschrift No. 2,928,450 and in other patent literature, oil lubrication is provided at or near the sealing means of a rotary valve. Regardless of whether the sealing means in conventional rotary valves comprises sealing strips extending along meridians thereof or, as described in German Offenlegungschrift No. 2,510,005, facing surfaces pressed against the rotary valve member and fitted with gaskets, oil lubrication is necessary. Consequently, the fundamental disadvantages of such rotary valves are high oil consumption and, despite the use of oil lubrication, a high frictional power loss, which adversely affects the efficiency of the engine.

Accordingly, it is an object of the present invention to provide a new and improved rotary valve arrangement which eliminates the disadvantages of the prior art rotary valve arrangments.

BRIEF SUMMARY OF THE INVENTION

In accordance with the present invention, the foregoing and other objects are attained by providing a rotary valve arrangement including a cylindrical valve member mounted for rotation in a valve housing and having a plurality of passageways with corresponding ports at the cylindrical surface thereof, and a plurality of dry-bearing sealing rings, having at least their bearing surfaces made of anti-friction materials, retained in grooves surrounding the valve member and disposed on opposite sides of the passageway ports so as to provide effective seals, preventing leakage between the passageway ports along the surface of the valve member. The valve housing also has a plurality of ports disposed at corresponding locations so as to communicate with the passageways in the valve member and the dry surface bearing seals similarly provide an effective seal which prevents leakage between the housing ports along the surface of the valve member.

For use in an internal combustion engine having several combustion chambers, for example, cylinders, the rotary valve arrangement of the invention comprises a plurality of axially adjacent subdivisions, each associated with one of the combustion chambers and having corresponding ports and dry-bearing sealing rings. With this arrangement, the subdivisions at the end of the valve member are sealed off from the outside, while the inner subdivisions are sealed off from the adjacent subdivisions of the rotary valve member. By contrast with the prior art, however, the invention eliminates the need for oil lubrication between the sealing rings and the inner surface of the valve housing, and between the sealing rings and the surface of the rotary valve member.

Furthermore, in the prior art, as described above, in order to seal off the defined surface areas in circumferential direction (so that there will not be any leakage between the rotary slide and its housing, and hence ultimately between combustion chamber and intake or exhaust port), additional sealing rings, strips or the like are provided, which also require oil lubrication. In contrast, the present invention provides an effective seal between the adjacent regions of the valve member and housing while permitting a suitable clearance between those elements to assure free rotation of the valve member. Because the clearance between the valve member and the housing is isolated by the sealing rings which confine the adjacent regions of the valve member, any gas leakage into the clearance is returned to the appropriate passage. If the ports of the valve member passages communicating with the intake and exhaust ports of the housing are diametrally opposed to the ports of the passages leading to the combustion chamber, the sealing gap will be of maximum length.

In order to ensure a surface seal of defined cross sectional area, in particular a defined clearance under all operating conditions, the rotary valve arrangement of the invention preferably has cooling passages in the housing, and the valve member is made of a material of low thermal coefficient of expansion or with appropriate thermal insulation so as to limit thermal variations in the clearance between the housing and the valve member. In addition, the surface of either the valve member or the housing forming the surface seal may be coated with an abrasive material to counteract any tendency of the rotary valve member to seize in the housing when the clearance is very small, which may, for example, result from wear in the bearings of the rotary valve member.

Moreover, to avoid the possibility of fusion of the surface areas of the housing and valve member adjacent to the exhaust, a material having a high melting point may be used in those regions. To avoid the possiblity of fusion of the gas sealing rings, there is preferably a comparatively long sealing gap between them and the passages in the valve housing leading to the combustion chamber, to act as a "fire barrier."

BRIEF DESCRIPTION OF THE DRAWINGS

A preferred embodiment of the invention will be described hereinafter with reference to the accompanying drawings, in which.

Figure 1:
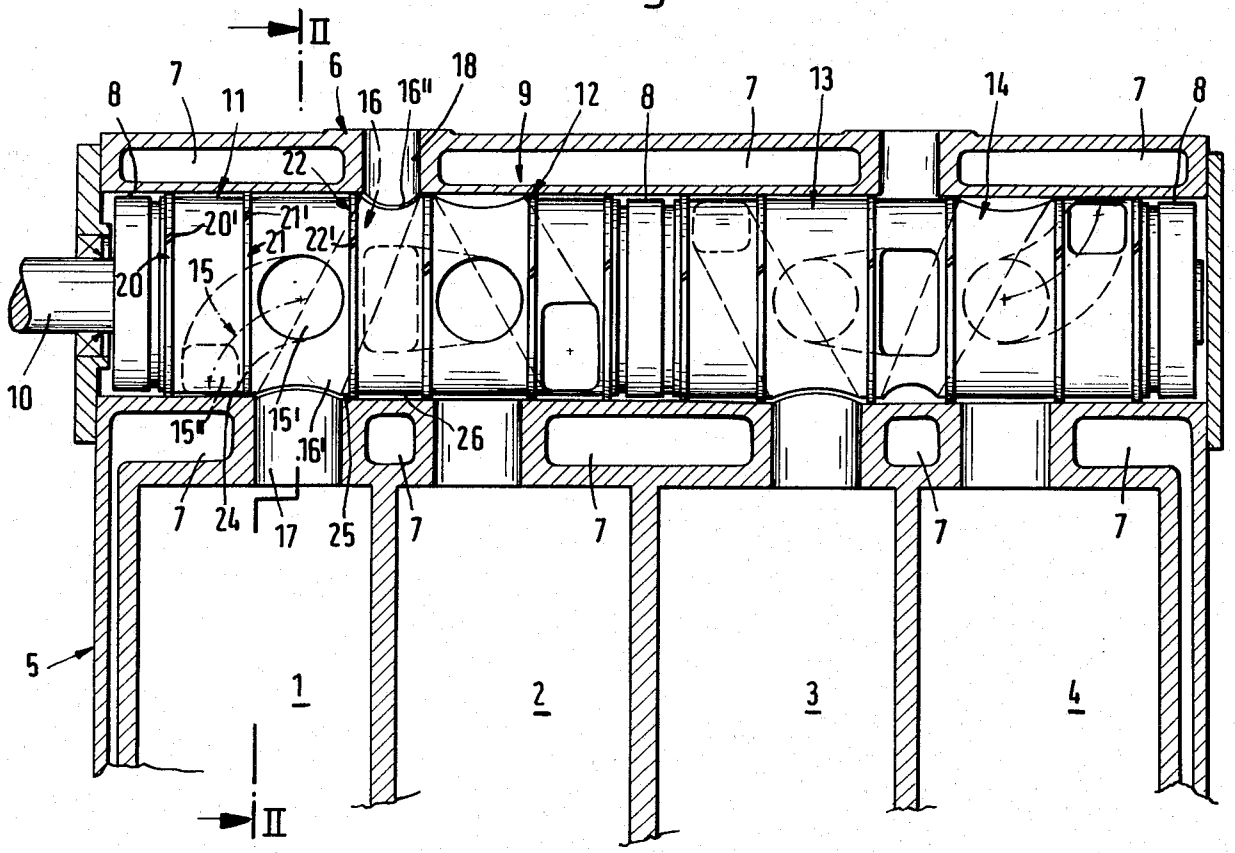
FIG. 1 is a vertical sectional view of the relevant portion of a four-cylinder reciprocating piston internal combustion engine illustrating an embodiment of the invention.

In the embodiment shown in the drawings, four cylinders 1, 2, 3 and 4 in the cylinder block 5 of an engine, together with pistons therein (not shown) form combustion chambers closed off at the top by a valve housing 6, which is cast in one piece with the cylinder block 5. The housing 6 contains a plurality of coolant passages and chambers generally designated by the numeral 7, arranged so that they substantially surround a rotary valve member 9 which is mounted on lubricated journal bearings 8 in the housing 6. The rotary valve member 9 is driven by a drive shaft 10 which is rotationally connected to the crankshaft of the engine through a gear belt drive for example (not shown), at a speed bearing a preassigned ratio, in this case 1:2, to the rotational speed of the engine.

Considering now the construction of the rotary valve member 9, it is divided longitudinally into four sections 11, 12, 13 and 14, each associated with one of the cylinders 1, 2, 3 and 4, respectively. The sections 11–14 are identical in structure, except for differences in orientation of the inlet and outlet passages provided in them, so that in the following description, only section 11 of the valve member, which communicates with the cylinder 1, will be described in detail.

Section 11 of the rotary valve member contains a supply passage 15 for intake gas, which is to say air in the case of an engine with direct injection of fuel into the cylinders, and an outlet passage 16 for exhaust gases generated by combustion of the fuel-air mixture in the cylinder 1. In the rotational position of the rotary valve member 9, which is shown in the drawings, the outlet passage 16 connects the combustion chamber of cylinder 1, by way of a passage 17 in the valve housing 6, to another passage 18 in the housing, where an exhaust pipe (not shown) is attached. The outlet passage 16 is straight with a centerline intersecting the longitudinal axis of the rotary valve member 9, and, in the position shown in the drawing, the ports 16' and 16'' at opposite ends of the outlet passage 6 are aligned with the housing passages 17 and 18.

Figure 2:
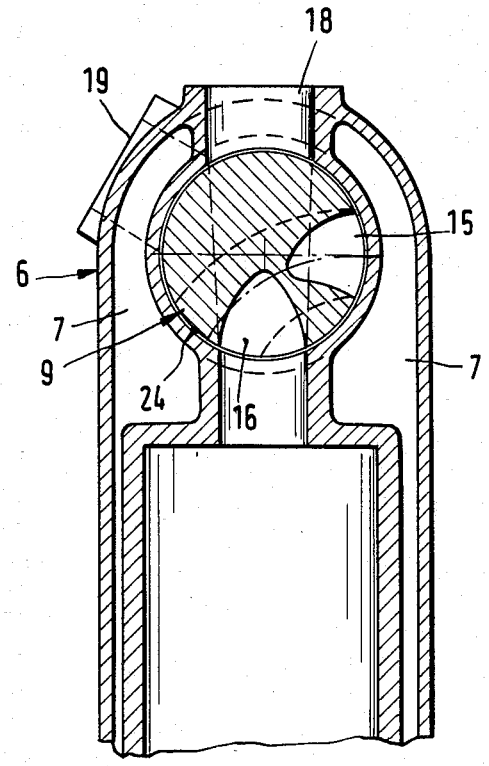
FIG. 2 is a cross-sectional view of the embodiment shown in FIG. 1, taken along the lines II—II of FIG. 1 and looking in the direction of the arrows.

The supply passage 15, which, as best seen in FIG. 2, has a curved centerline, terminates in two ports 15' and 15'' which, in the position shown in the drawings, are closed off by the surface of the valve housing 6, so that in this position, the passage 15 is inoperative. After a clockwise rotation of the valve member 9, as seen in FIG. 2, through about 90°, the port 15' is aligned with the housing passage 17 and the port 15'' is aligned with another housing passage 19, shown in FIG. 2, where an intake pipe (not shown) is attached. In that position of the valve member 9, intake gas will be supplied to the cylinder 1 during the intake stroke of that cylinder.

In accordance with the invention, a sealing means is provided in certain regions of the neighborhood of the rotary valve member 9. Here too, because the other sections 12, 13 and 14 of the rotary member are identical, the description will be confined to section 11. For this purpose, three dry-bearing gas-sealing rings 20, 21 and 22, are mounted in corresponding circumferential grooves in the surface of the valve member 9. To assure low friction, the sliding surfaces of the sealing rings are made of sintered material or the rings are made of carbon. As shown in FIG. 1, the sealing rings have slits 20, 21 and 22 and, in this embodiment by way of example, the rings are prestressed. If desired, the slits 20', 21' and 22' may be held, by appropriate retaining means (not shown) in the housing 6, at locations which are diametrically opposite to the housing passage 17 leading to the combustion chamber.

The function of the gas-sealing ring 20 is essentially to prevent passage of oil or grease from the bearing 8 to the neighboring gas-sealing ring 21. The two gas-sealing rings 21 and 22 are arranged to ensure that, despite greatly differing gas pressures in housing passages 17, 18 and 19, i.e., the combustion chamber pressure, the exhaust back-pressure and the intake pressure (negative in aspirating mode, positive in supercharge mode), there will be no by-pass leaks to the rotary valve member passages 15 and 16. This function is performed by the gas-sealing rings in cooperation with three surface seals 24, 25 and 26 in the clearance between the housing 6 and the valve member 9, the widths of which are, of course, exaggerated in the drawing. In addition, the surface of either the valve member or the housing may be coated with an abrasive material to grind the adjacent surface so as to form a matching fit and prevent seizure of the valve member in the housing. The thickness of the surface seals 24, 25 and 26 is preferably about equal to the play in the support bearings 8 and, if desired, a supplemental coating of anti-friction material may be provided on one or the other of the housing and valve member surfaces. At the upper end of the housing passage 17 another dry-bearing sealing member (not shown), subject to gas pressure and/or spring action, may, if desired, be arranged to encircle outlet of the passage 17.

The sealing effect of the surface seals obviously depends on the width of the surface clearance when the engine is in operation, including operation at very high exhaust temperatures. Accordingly, it is desirable not only to provide for liquid cooling of the housing through the passages as ihdicated at 7, which cooling likewise surrounds the entire rotary valve member 9, but also to select a material for the valve member 9 which will have a high heat resistance as well as a low heat expansion and low heat conduction. Suitable materials are high-alloy steel, carbon, ceramic, metal-ceramic composite and ceramic or carbon fiber and metal composite materials. In addition, to improve the heat insulation in the rotary valve member, the exhaust passages may have walls which are made of an insulating material or which are spaced by air chambers from the body of the valve members and insulating inclusions in the form of ceramic elements or air spaces (not shown) may be provided in the valve member.

Although the invention has been described with reference to a specific embodiment, may modifications will readily occur to those skilled in the art. For example, the valve housing 6 need not be made in one piece with the cylinder block 5. In any case, the invention provides an improved rotary valve arrangement having significant advantages over a tappet valve arrangement, along with advantageous properties as to oil consumption and reduced friction.

I claim:

1. A rotary valve arrangement for an internal combustion engine, comprising a housing having a plurality of cylinders with corresponding passages, an intake gas passage and an exhaust gas passage, a rotary valve member mounted for rotation in the housing and having inlet and outlet passages for intake and exhaust gases with ports which, from time to time, are aligned with cylinder intake and exhaust passages in the housing, depending on the angle of rotation, and a plurality of dry-bearing sealing rings retained in corresponding grooves surrounding the valve member and axially adjacent to the ports in the valve member, wherein the dry-bearing sealing rings have an anti-friction material on the sliding surface thereof, the valve arrangement further comprising at least one heat resistant dry surface bearing seal provided between the valve member and the housing in the spaces between the dry-bearing sealing rings so as to inhibit peripheral leakage of gases therebetween.

2. A rotary valve arrangement according to claim 1 including oil-lubricated bearing means supporting the valve member for rotation in the housing and at least one of the dry-bearing sealing rings is disposed between the oil-lubricated bearing means and the dry surface bearing seal.

3. A rotary valve arrangement according to claim 1 or 2 wherein the sliding surfaces of the dry-bearing sealing rings are made of sintered material.

4. A rotary valve arrangement according to claim 1 or 2 wherein the dry-bearing sealing rings are carbon rings.

5. A rotary valve arrangement according to claim 1 or 2 wherein the housing includes cooling passages substantially surrounding the rotary valve member.

6. A rotary valve arrangement according to claim 1 or 2 wherein the rotary valve member is made with a material of low thermal coefficient of expansion and low heat conductivity.

7. A rotary valve arrangement according to claim 6 wherein the rotary valve member is made with a material from the group consisting of high-alloy steel, carbon, ceramic, metal-ceramic composite, and ceramic or carbon fiber composite material.

8. A rotary valve arrangment according to claim 1 or 2 wherein the surface of the rotary valve member or the adjacent surface of the valve housing is provided with a coat of abrasive material between the dry-bearing sealing rings to avoid seizure of the valve member in the housing.

9. A rotary valve arrangement according to claim 1 or 2 wherein the dry surface bearing seal comprises a layer of dry lubricant material.

10. A rotary valve arrangement according to claim 1 or 2 wherein the surface of one of the rotary valve members and the valve housing contains a material having a high melting point in the spaces between the sealing rings.

11. A rotary valve arrangement according to claim 1 or 2 wherein the surface of one of the rotary valve members and the valve housing is coated with an anti-friction layer in the spaces between the sealing rings.

12. A rotary valve arrangement according to claim 1 or 2 wherein the rotary valve member is formed with heat-insulating inclusions.

13. A rotary valve arrangement according to claim 1 or 2 wherein the outlet passages in the rotary valve member have heat-insulating walls.

14. A rotary slide valve arrangement according to claim 1 or 2 wherein the dry surface bearing seal comprises a dry-bearing selaing member in the surface of the valve housing surrounding each of the cylinder passages therein.

15. A rotary valve arrangement according to claim 2 wherein the thickness of the dry surface bearing seal is approximately equal to the play of the oil-lubricated bearing means supporting the rotary valve member.

* * * * *